US007704376B2

(12) United States Patent
Varadaraj et al.

(10) Patent No.: US 7,704,376 B2
(45) **Date of Patent: *Apr. 27, 2010**

(54) FOULING INHIBITION OF THERMAL TREATMENT OF HEAVY OILS

(75) Inventors: Ramesh Varadaraj, Flemington, NJ (US); Michael Siskin, Randolph, NJ (US); Leo D. Brown, Baton Rouge, LA (US); Maa S. Maa, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1106 days.

This patent is subject to a terminal disclaimer.

(21) Appl. No.: 11/127,733

(22) Filed: May 12, 2005

(65) Prior Publication Data

US 2005/0258070 A1 Nov. 24, 2005

Related U.S. Application Data

(60) Provisional application No. 60/571,308, filed on May 14, 2004.

(51) Int. Cl.
*C10G 9/16* (2006.01)

(52) U.S. Cl. ..... 208/48 AA; 208/265; 208/282; 44/363; 210/698; 516/20; 516/909; 562/45; 562/88; 562/91

(58) Field of Classification Search ..... 44/363; 208/48 AA, 265, 282; 210/698; 516/20, 516/909; 562/45, 88, 91
See application file for complete search history.

(56) References Cited

U.S. PATENT DOCUMENTS

| | | | | |
|---|---|---|---|---|
| 2,626,207 | A * | 1/1953 | Wies et al. | 44/363 |
| 2,843,530 | A | 7/1958 | Langer, Jr. et al. | |
| 3,105,810 | A * | 10/1963 | Miller et al. | 208/48 AA |
| 3,558,474 | A | 1/1971 | Gleim et al. | 208/108 |
| 3,617,514 | A | 11/1971 | Marlar | 208/131 |
| 3,684,697 | A | 8/1972 | Gamson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,140,623 | A | 2/1979 | Sooter et al. | 208/131 |
| 4,226,805 | A | 10/1980 | Bauer | |
| 4,298,455 | A | 11/1981 | Huang | 208/48 AA |

(Continued)

FOREIGN PATENT DOCUMENTS

EP 0031697 7/1981

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Glenn Caldarola
*Assistant Examiner*—Prem C. Singh
(74) *Attorney, Agent, or Firm*—Bruce M. Bordelon; Gerard J. Hughes

(57) ABSTRACT

The use of water-soluble aromatic polysulfonic acid salts for inhibiting fouling in process equipment used in the thermal treatment of heavy oils.

4 Claims, 4 Drawing Sheets

U.S. PATENT DOCUMENTS

| | | | | |
|---|---|---|---|---|
| 4,399,024 | A | 8/1983 | Fukui et al. | 208/131 |
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,478,729 | A | 10/1984 | Hunt et al. | |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,615,791 | A | 10/1986 | Choi et al. | |
| 4,616,308 | A | 10/1986 | Morshedi et al. | 364/159 |
| 4,619,756 | A | 10/1986 | Dickakian | |
| 4,659,453 | A | 4/1987 | Kukes et al. | |
| 4,670,165 | A | 6/1987 | Black et al. | |
| 4,847,018 | A | 7/1989 | Koepke et al. | |
| 4,927,561 | A | 5/1990 | Forester | 252/389.22 |
| 4,966,679 | A | 10/1990 | Kubo et al. | |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,296,130 | A | 3/1994 | Kriz et al. | |
| 5,460,714 | A | 10/1995 | Fixari et al. | 208/112 |
| 5,645,711 | A | 7/1997 | Hraban et al. | 208/131 |
| 5,650,072 | A * | 7/1997 | Mc Clain et al. | 210/698 |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |
| 2005/0258071 | A1 * | 11/2005 | Varadaraj et al. | 208/48 AA |
| 2005/0263438 | A1 * | 12/2005 | Varadaraj et al. | 208/48 AA |

FOREIGN PATENT DOCUMENTS

| | | |
|---|---|---|
| EP | 175511 | 6/1988 |
| GB | 1218117 | 1/1971 |
| WO | 95/14069 | 5/1995 |
| WO | 99/64540 | 12/1999 |
| WO | 03042330 | 5/2003 |
| WO | 03048271 | 6/2003 |
| WO | 2004/038316 | 5/2004 |
| WO | 2004/104139 | 12/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

* cited by examiner

FOULING INHIBITION OF THERMAL TREATMENT OF HEAVY OILS

CROSS-REFERENCE TO RELATED APPLICATION

This application claims benefit of U.S. Provisional Patent Application 60/571,308 filed May 14, 2004.

FIELD OF THE INVENTION

The present invention relates to the use of water-soluble aromatic polysulfonic acid salts for inhibiting fouling in process equipment used in the thermal treatment of heavy oils.

BACKGROUND OF THE INVENTION

Heavy oils are generally referred to those hydrocarbon comprising oils with high viscosity or API gravity less than about 20. Crude oils and crude oil residuum obtained after atmospheric or vacuum distillation of crude oils that exhibit an API gravity less than about 20 are examples of heavy oils. Upgrading of heavy oils is important in production, transportation and refining operations. An upgraded heavy oil typically will have a higher API gravity and lower viscosity compared to the heavy oil that is not subjected to upgrading. Lower viscosity will enable easier transportation of the oil. A commonly practiced method for heavy oil upgrading is thermal treatment of heavy oil. Thermal treatment includes processes such as visbreaking and hydro-visbreaking (visbreaking with hydrogen addition).

Primary limitations in thermal treatment of heavy oils, such as visbreaking, are the formation of toluene insolubles (TI) at high process severities and reactor fouling. Fouling of the reactor vessel results in down time as well as energy losses. The instant invention addresses the fouling limitation of thermal treatment, such as visbreaking and presents a method for improved operability of a heavy oil thermal treatment facility.

SUMMARY OF THE INVENTION

In one embodiment, there is provided a method for inhibiting the fouling of surfaces of process equipment in contact with heavy oil during thermal treatment, which method comprises:

a) adding to said heavy oil an effective amount of a water-soluble inhibitor additive to provide an inhibitor additized heavy oil, which water-soluble inhibitor additive is represented by the chemical structure:

$$Ar—(SO_3^-X^+)_n$$

where Ar is a homonuclear aromatic group of at least 2 rings, X is a metal selected from the alkali and alkaline-earth metals, and n is an integer from 1 to 5 when an alkali metal is used and 2 to 10 when an alkaline-earth metal is used;

b) thermally treating said inhibitor additized heavy oil at a temperature in the range of about 250° C. to 500° C. for a time between about 0.1 to 10 hours.

In a preferred embodiment the aromatic ring structure is a polynuclear ring structure comprised of about 2 to 15 aromatic rings.

DETAILED DESCRIPTION OF THE INVENTION

Figure 1:
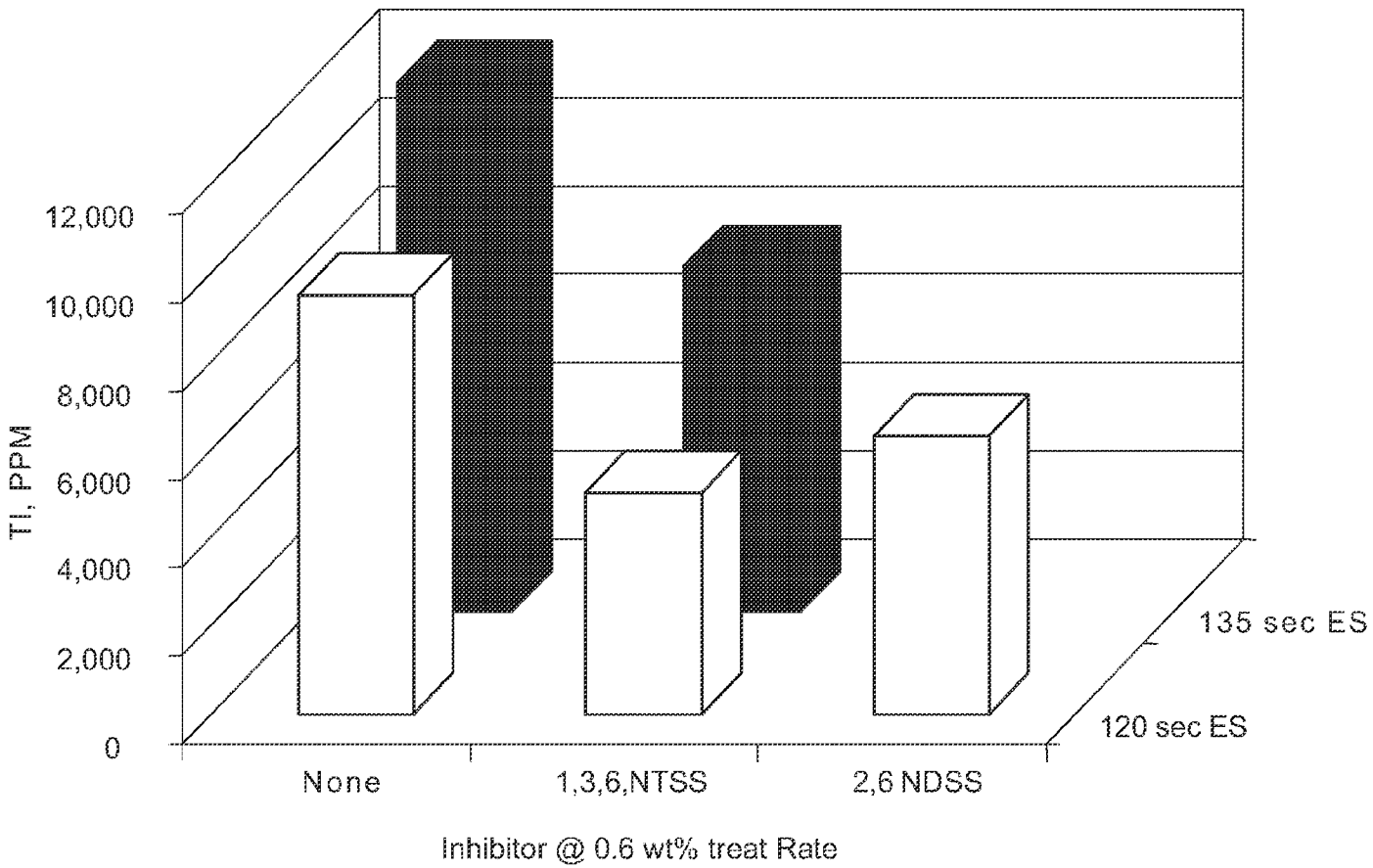
FIG. 1 hereof is a bar graph of toluene insolubles (TI) for thermally treated Athabasca bitumen with no additive labeled none and with two additives 1,3,6-NTSS and 2,6-NDSS FIG. 2 hereof is a is a bar graph of toluene insolubles (TI) for thermally treated Athabasca bitumen with no additive labeled none and with the additive 1,3,6-NTSS worked up according to scheme-1 and scheme-2.
Figure 2:
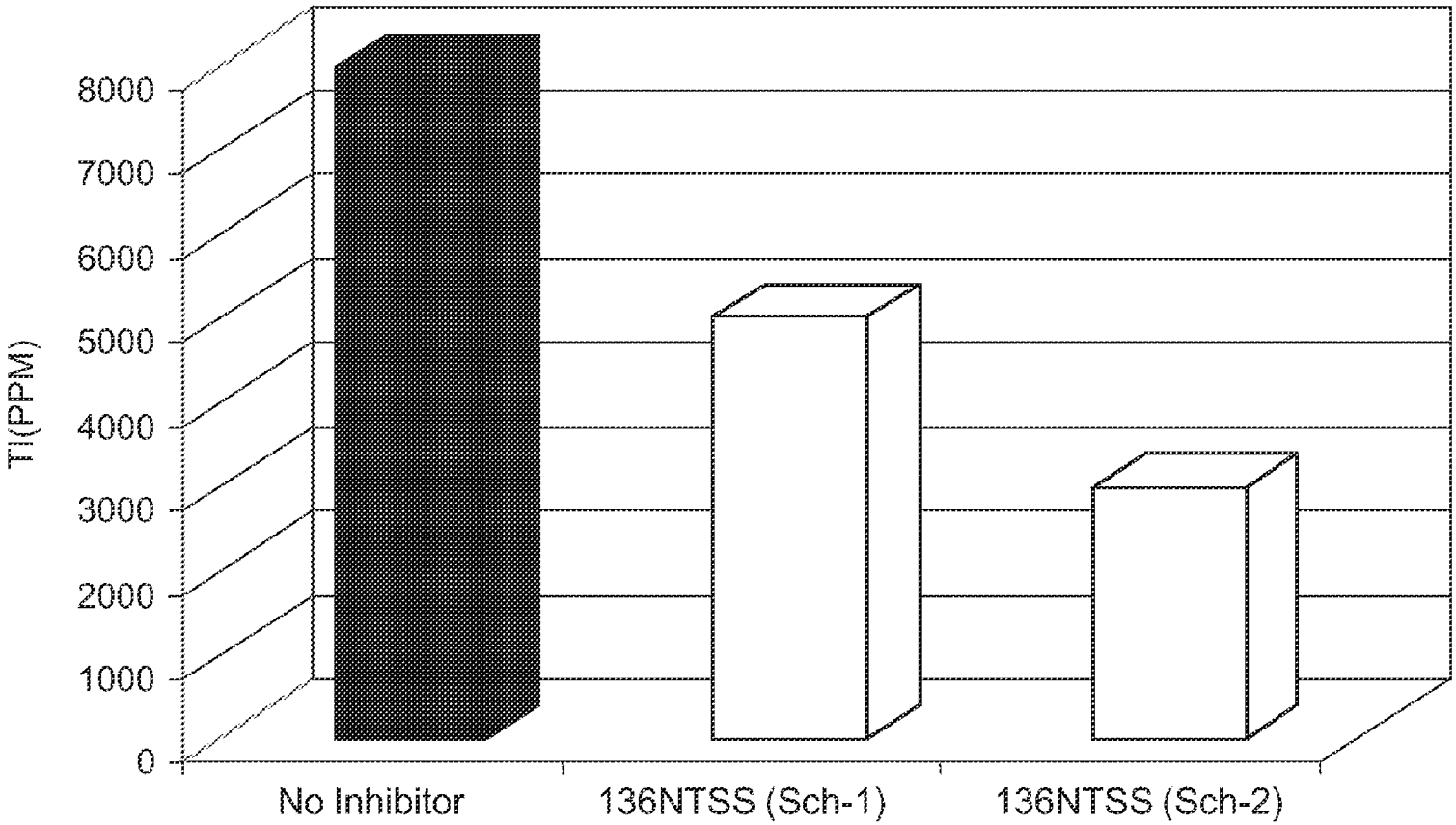

According to one embodiment of the invention, there is provided a method for inhibiting the fouling of surfaces of process equipment, such are vessels, pipes, and furnace tubes in contact with a heavy oil during thermal treatment, such as visbreaking and coking. Non-limiting examples of heavy oils include crude oil, vacuum resid, atmospheric resids, coal liquids, and shale oils. The present invention involves adding to said heavy oil, prior to thermal treatment, an effective amount of a water-soluble aromatic polysulfonic acid. The effective amount of the aromatic polysulfonic acid product is added to the heavy oil followed by thermal treatment at temperatures in the range of about 250° C. to 500° C. for about 30 second to 6 hours. The aromatic polysulfonic acid product is often referred to herein as an inhibitor additive.

As previously mentioned, the preferred inhibitor additive of the present invention is an aromatic polysulfonic acid salt of the chemical structure:

$$Ar—(SO_3^-X+)_n$$

where Ar is a homonuclear aromatic group of at least 2 rings, X is selected from Group I (alkali) and Group II (alkaline-earth) elements of the periodic table of elements and n is an integer from 1 to 5 when an alkali metal is used and from 2-10 when an alkaline earth metal is used. Preferably X is selected from the alkali metals, preferably sodium or potassium and mixtures thereof. It is preferred that Ar have from about 2 to 15 rings, more preferably from about 2 to 4 rings, and most preferably from about 2 to 3 rings. It is within the scope of this invention that the aromatic polysulfonic acid salts of the present invention be prepared from the polysulfonation of a light catalytic cycle oil. Light catalytic cycle oil is a complex combination of hydrocarbons produced by the distillation of products from the fluidized catalytic cracking (FCC) process with carbon numbers in the range of about $C_9$ to about $C_{25}$, boiling in the approximate range of 340° F. (171° C.) to 700° F. (371° C.). Light catalytic cycle oil is also referred to herein as light cat cycle oil and LCCO. LCCO is generally rich in 2-ring aromatic molecules. LCCO from a US refinery typically comprises about 80% aromatics. The aromatics are typically 33% 1-ring aromatics and 66% 2-ring aromatics. Further, the 1- and 2-ring aromatics can be methyl, ethyl and propyl substituted. The methyl group is the major substituent. Nitrogen and sulfur containing heterocycles, such as indoles and benzothiophenes are also present in minor quantities.

Non-limiting examples of preferred polysulfonic aromatic acid salts of the present invention are shown below.

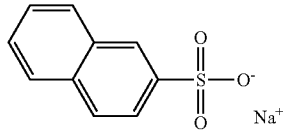

naphthalene-2-sulfonic acid sodium salt

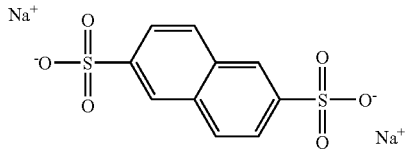

naphthalene-2,6-disulfonic acid sodium salt

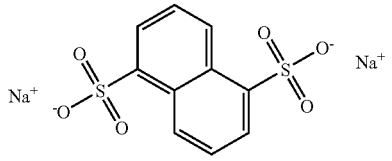

naphthalene-1,5-disulfonic acid sodium salt

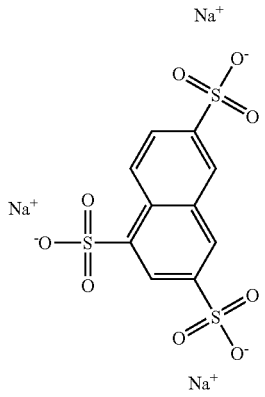

naphthalene-1,3,6-trisulfonic acid sodium salt

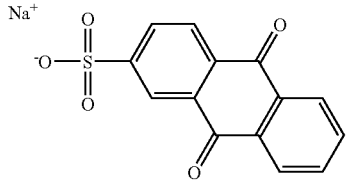

anthraquinone-2-sulfonic acid sodium salt

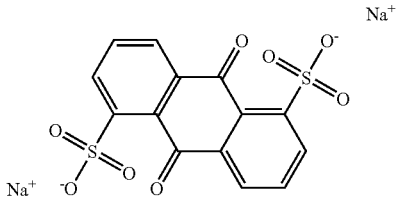

anthraquinone-1,5-disulfonic acid sodium salt and

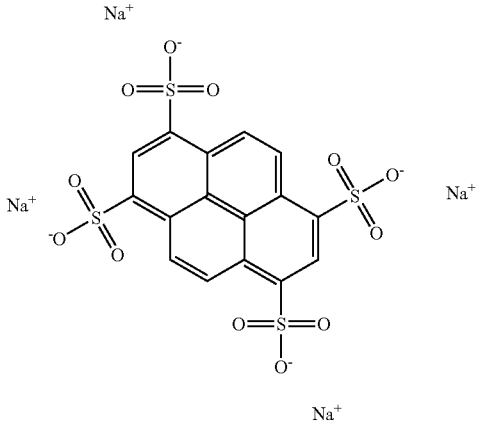

pyrene-1,3,6,8-tetra sulfonic acid sodium salt

The polysulfonic acid compositions can be produced from LCCO by a process that generally includes the polysulfonation of the LCCO with a stoichiometric excess of sulfuric acid at effective conditions. Conventional sulfonation of petroleum feedstocks typically use an excess of the petroleum feedstock—not an excess of sulfuric acid. It has unexpectedly been found by the inventors hereof that when a stoichiometric excess of sulfuric acid is used to sulfonate an LCCO the resulting polysulfonated product has novel properties and uses. The aromatic polysulfonic acid is converted to the aromatic polysulfonic acid salt by treatment with an amount of caustic to neutralize the acid functionality. The LCCO polysulfonic acid composition can best be described as a mixture of 1- and 2-ring aromatic cores with 1 or more sulfonic acid groups per aromatic core. The aromatic cores are methyl, ethyl, and propyl substituted, with the methyl group being the more preferred substituent.

Typically, the amount of inhibitor additive added can be about 10 to about 50,000 wppm, preferably about 20 to 3000 wppm, and more preferably 20 to 1000 wppm based on the amount of crude oil or crude oil residuum. The inhibitor additive can be added as is or in a suitable carrier solvent, preferably water or water-alcohol mixtures as the carrier solvent. Preferred alcohols are methanol, ethanol, propanol and mixtures thereof. The carrier solvent is preferably 10 to 80 weight percent of the mixture of additive and carrier solvent.

Contacting the inhibitor additive with the heavy oil can be achieved at any time prior to the thermal treatment. Contacting can occur at the point where the heavy oil is produced at the reservoir, during transportation or at a refinery location. In the case of crude oil resids, the inhibitor additive is contacted at any time prior to thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of 10° C. to 150° C. After contacting and mixing the heavy oil and additive, the mixture can be cooled from about contacting temperature to about ambient temperature, i.e., about 15° C. to 30° C. Further, the additized-cooled mixture can be stored or transported from one location to another location prior to thermal treatment. Alternately, the additized and cooled mixture can be thermally treated at the location of contacting if so desired.

Thermal treatment of the additized heavy oil comprises heating the oil at temperatures in the range of about 250° C. to 500° C. for about 30 seconds to 6 hours. Process equipment, such as visbreakers, can be advantageously employed to conduct the thermal treatment. It is preferred to mix the additized heavy oil during thermal treatment using mixing means known to those having ordinary skill in the art. It is also preferred to conduct the thermal treatment process in an inert environment. Using inert gases such as nitrogen or argon gas in the reactor vessel can provide such an inert environment Practice of the present invention inhibits surface fouling of the internals of a process unit, particularly the reaction vessel used to thermally convert heavy oil to light products. Practice of the present invention also substantially reduces the rate of coking or fouling.

The following examples are included herein for illustrative purposes and are not meant to be limiting.

Example 1

120 g of bitumen was rapidly heated under nitrogen (350 PSI) to 750° F. with continuous stirring at 1500 RPM. The bitumen was allowed to react under these conditions for a period of time calculated to be equivalent to a short visbreaking run at a temperature of 875° F. (typically 120 to 180 "equivalent seconds"). After achieving the desired visbreaking severity, the autoclave was rapidly cooled in order to stop any further thermal conversion. The inside of the autoclave was observed to be fouled with a carbonaceous deposit when the bitumen was thermally treated as described above. When the 1,3,6-NTSS additive of the instant invention was used at treat rates from about 500 to 6000 ppm based on the weight of the bitumen the inside of the reactor was observed to be clean with substantially no carbonaceous deposits.

Example 2

Thermal Stability of Additive

Figure 3:
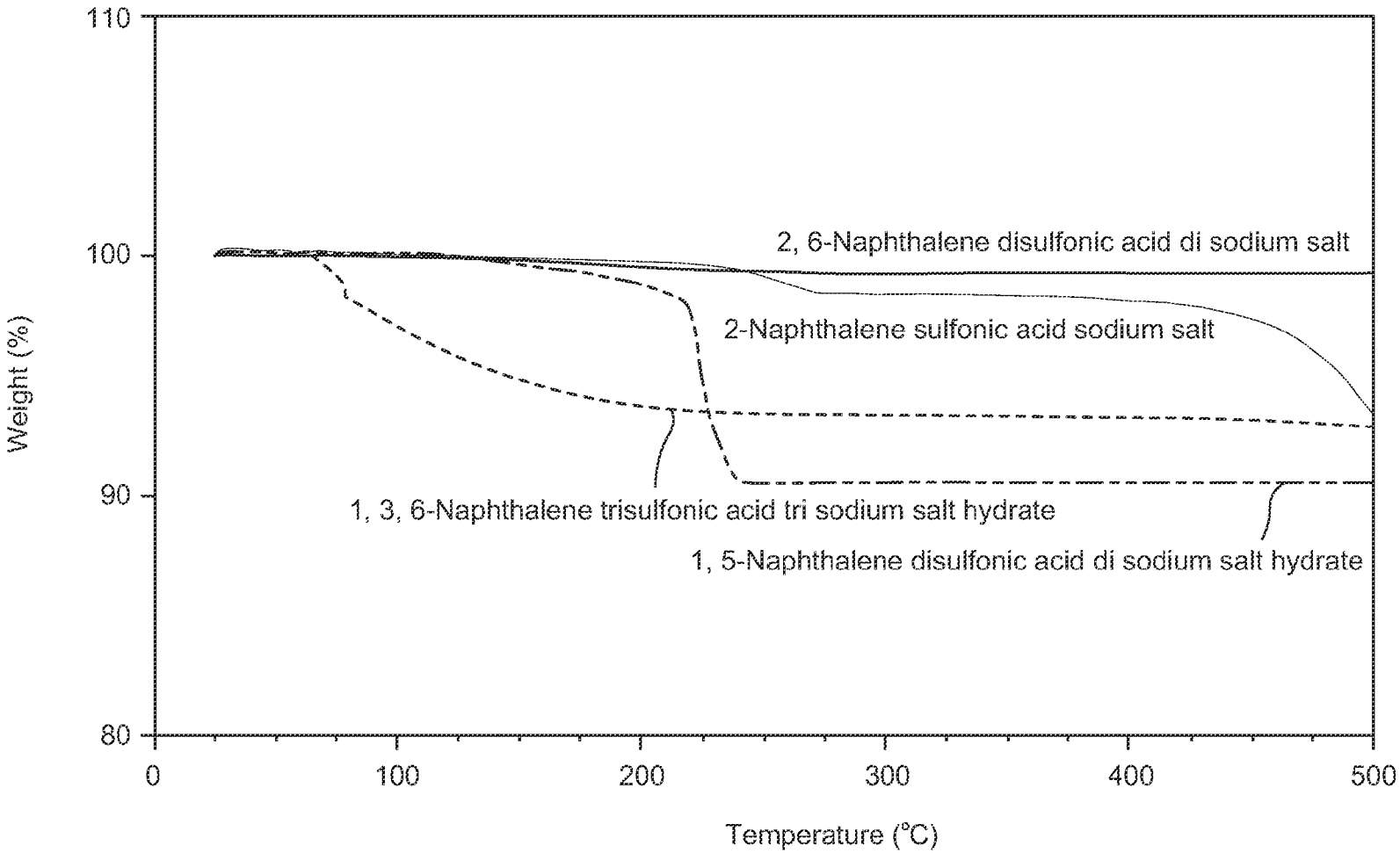
FIG. 3 hereof is thermogravimetry plot of the aromatic polysulfonic acid salts used in the example herein and shows that they are thermally stable up to 500° C.
Figure 4:
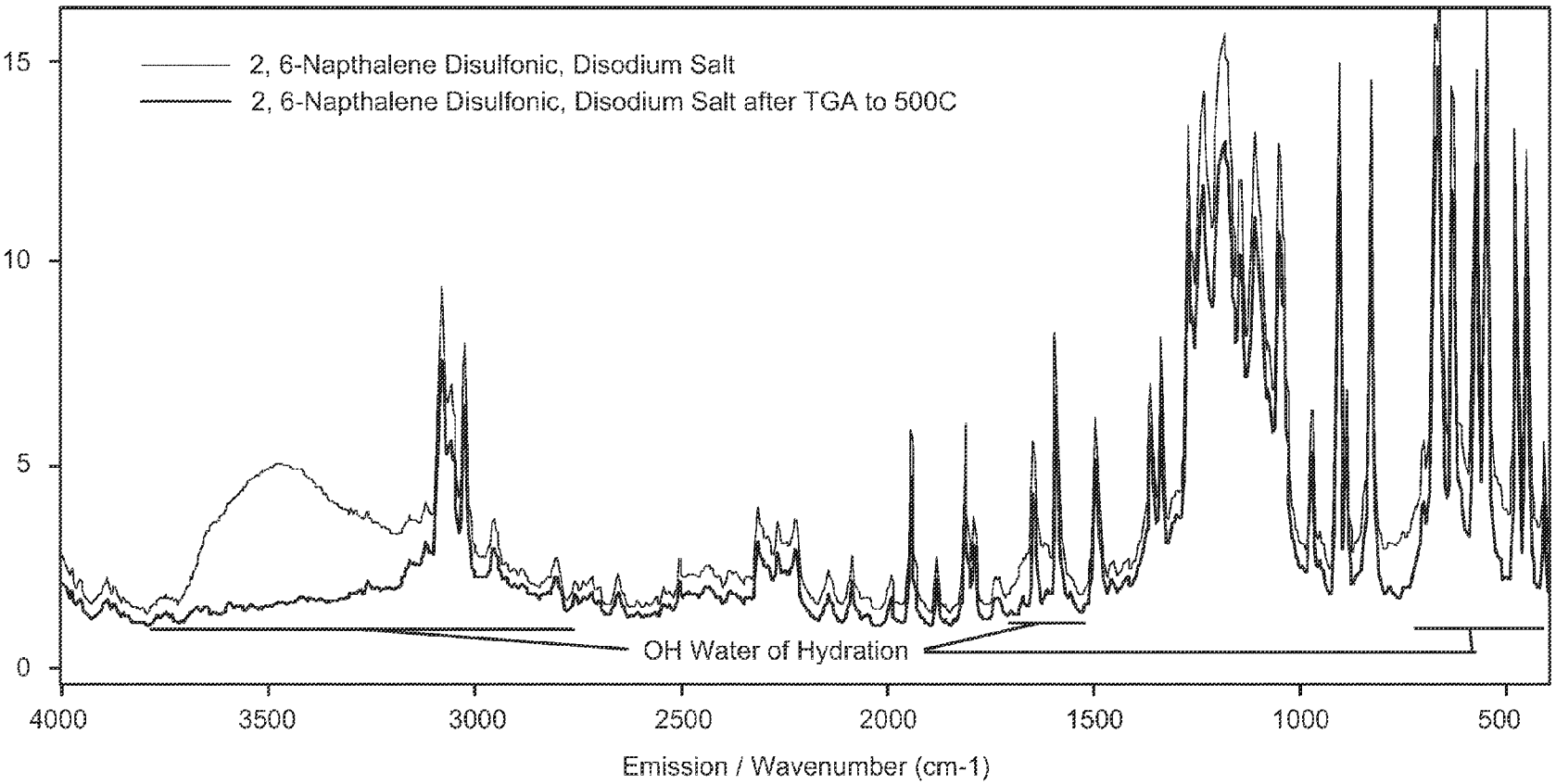
FIG. 4 is a Photoacousitic Fourier Transform Spectral of 2,6-naphthalene disulfonic acid disodium salt before and after the TGA example herein and shows that the additive does not degrade chemically upon heating to 500° C.

One requirement for the additive to be effective was that it is thermally stable under the thermal conversion conditions. Thermogravimetry experiments were conducted and the data for the suite of aromatic sulfonic acid sodium salts revealed (FIG. 3 hereof) the additives are thermally stable up to 500° C. as evidenced by less than 10% weight loss. The Photoacoustic Fourier Transform Spectroscopy was done on of 2,6-naphthalene disulfonic acid disodium salt before and after the TGA experiment we observed the additive does not degrade chemically upon heating to 500° C. (FIG. 4 hereof). Only loss of water/hydration is observed.

Example 3

Wettabilty of Steel Surface

Another desired attribute for the additive to be effective is that the wettability of the additive treated oil on a steel surface be lower compared to the untreated oil. Lower wetting can translate to lower surface fouling. This property was observed in the following high temperature wettability experiment.

Cold Lake crude oil (20 g) was additized with 1,3,7-naphthalene tri sulfonic acid tri sodium salt (1,3,7-NTSS) (0.12 g) to provide a 0.6 wt % additive in the oil. The additive was delivered as a solution in 5 ml of water. The solution was added to the oil and mixed to form a water-in-oil emulsion. The emulsion was heated to 100° C. to evaporate off the water to result in an additized oil with dispersed additive. The additized oil and untreated oil were subject to a high temperature wettability test. A steel plate was heated to 200° C. and a droplet of each of the oils was placed on the hot plate using a microsyringe. The contact angle of the oil on the hot steel surface was measured by photographing the droplet.

The untreated oil wetted the steel surface with a contact angle of about 30° whereas the treated oil was observed to assume a spherical shape indicating lower wetting tendency for the additized oil. The contact angle for the additized oil was about 130° C. The observed higher contact angle indicates lower wettability for the additized oil.

Example 4

Additive Surfactancy

Three representative additives 2,6-naphthalene sulfonic acid disodium salt (2,6-NDSS), 1,3,6-naphthalene tri sulfonic acid tri sodium salt (1,3,6-NTSS), and 2-naphthalene sulfonic acid sodium salt (2-NSS) were tested for surfactancy. A 0.5 wt % solution of each of the additives was made in water. The water-air surface tension was determined for each additive at 25° C. using the Wilhelmy plate method.

Results shown in Table 1 below reveal the three additives possess unexpectedly high surfactancy. Water has a surface tension of 72 dynes/cm. The magnitude of decrease in surface tension from 72 is a measure of surfactancy. Based on the structure of the additives one would expect a maximum of 10 dyne/cm decrease in surface tension. A 30 to 50 dyne/cm reduction is observed. This is unexpected based on the additive structure. One would expect a long aliphatic chain is essential on the naphthalene ring to impart surfactancy. Observations are contrary to this expectation. The unexpectedly high surfactancy combined with high thermal stability is desirable for high temperature surfactancy performance.

TABLE 1

Additive Surfactancy

| Solution | Surface Tension (dynes/cm) |
|---|---|
| Water | 72 |
| 2-NSS | 43.1 |
| 2,6-NDSS | 23.2 |
| 1,3,6-NTSS | 21.2 |

Example 5

A Micro Concarbon Residue (MCCR) test was conducted on a vacuum resid that was treated with the naphthalene sulfonic acid salts. As observed in the Table 2 below, addition of 3000 wppm of the naphthalene sulfonic acid sodium salts lowered the micro Concarbon residue indicative of potential to inhibit fouling.

TABLE 2

| | MCR (wt. %) |
|---|---|
| Heavy Canadian Vacuum Resid (HCVR) | 22.86 |
| HCVR + 3000 wppm 2,6-NDSS | 21.57 |
| HCVR + 3000 wppm 1,3,6-NTSS | 20.77 |

Example 6

Autoclave Fouling Experiment

In a typical visbreaking autoclave run, 120 g of Athasbasca bitumen was rapidly heated under nitrogen (350 PSI) to 750° F. with continuous stirring at 1500 RPM. Inside the autoclave was suspended 304 steel coupons (0.5 inch by 0.75 inch). The bitumen was allowed to react under these conditions for a period of time calculated to be equivalent to a short visbreaking run at a temperature of 875° F. (typically 120 to 180 "equivalent seconds"). After achieving the desired visbreaking severity, the autoclave was rapidly cooled in order to stop any further thermal conversion. The test coupons were taken out, cooled, rinsed with toluene and subject to visual examination. It was observed that fouling was substantially reduced on the coupons that were subjected to 0.6 wt % of 1,3,6-NTSS as opposed to the coupon run without an additive of the present invention.

The invention claimed is:

1. A method for inhibiting the fouling of surfaces of process equipment used in the thermal upgrading of heavy oils which method comprises:

a) contacting the heavy oil with an effective amount of a water-soluble inhibitor additive to provide an inhibitor additized heavy oil, which water-soluble inhibitor additive is selected from the group consisting of naphthalene-2-sulfonic acid sodium salt, naphthalene-2,6-disulfonic acid sodium salt, naphthalene-1,5-disulfonic acid sodium salt, naphthalene-1,3,6-trisulfonic acid sodium salt, anthraquinone-2-sulfonic acid sodium salt, anthraquinone-1,5-disulfonic acid sodium salt, and pyrene-1,3,6,8-tetra sulfonic acid sodium salt; and b) thermally treating said inhibitor additized heavy oil at a temperature in the range of about 250° C. to 500° C. for a time between about 0.1 to 10 hours in a thermal upgrading process unit.

2. The method of claim 1 wherein the heavy oil is a vacuum resid.

3. The method of claim 1 wherein the effective amount of additive is from about 10 to 50,000 wppm based on the weight of the heavy oil.

4. The method of claim 3 wherein the effective amount of additive is from about 20 to 3,000 wppm.

* * * * *